United States Patent [19]

Sata

[11] Patent Number: 4,722,572

[45] Date of Patent: Feb. 2, 1988

[54] LATCH AND RELEASE MECHANISM FOR WHEELCHAIR FOOTREST

[75] Inventor: Dwight O. Sata, Bloomington, Minn.

[73] Assignee: Theradyne Corporation, Lakeville, Minn.

[21] Appl. No.: 861,351

[22] Filed: May 9, 1986

[51] Int. Cl.[4] ..... A47C 7/52

[52] U.S. Cl. ..... 297/433

[58] Field of Search ..... 280/242 WC, 289 WC; 297/429, 433, 423, 427

[56] References Cited

U.S. PATENT DOCUMENTS

| | | | |
|---|---|---|---|
| 2,592,449 | 4/1952 | Miller | 297/429 |
| 2,601,379 | 6/1952 | Everest et al. | 280/47.39 |
| 2,601,889 | 7/1952 | Everest et al. | 297/433 |
| 2,793,682 | 5/1957 | Duke | 297/433 |
| 2,868,275 | 1/1959 | Mize | 297/429 |
| 2,960,150 | 11/1960 | Bauer et al. | 297/429 |
| 3,189,385 | 6/1965 | Mommsen | 297/429 |
| 3,205,006 | 9/1965 | Mommsen | 297/423 |
| 3,205,007 | 9/1965 | Sommer | 297/429 |
| 3,212,817 | 10/1965 | Sully | 297/429 |
| 3,376,067 | 4/1968 | Kernes | 297/427 |
| 3,453,027 | 7/1969 | Pivacek | 297/429 |
| 3,482,873 | 12/1969 | Pivacek | 297/429 |
| 3,758,150 | 9/1973 | Williams | 297/45 |
| 3,761,129 | 9/1973 | Schultz | 297/433 |
| 3,790,212 | 12/1974 | Suyetani | 297/429 |
| 3,854,774 | 12/1974 | Limpach | 297/429 |
| 3,857,606 | 12/1974 | Rodaway | 297/429 |
| 4,120,532 | 10/1978 | Clanan | 297/429 |
| 4,176,879 | 12/1979 | Rodaway | 297/429 |

FOREIGN PATENT DOCUMENTS

| | | | |
|---|---|---|---|
| 1404930 | 9/1975 | United Kingdom | 297/429 |

*Primary Examiner*—John J. Love
*Assistant Examiner*—Mitchell J. Hill
*Attorney, Agent, or Firm*—Orrin M. Haugen; Thomas J. Nikolai; Frederick W. Niebuhr

[57] ABSTRACT

A latch and release mechanism, for releasably locking a footrest assembly relative to a wheelchair frame member, includes a locking pin supported by the frame member and spring biased into engagement with the footrest assembly, and a release lever pivotally mounted to the frame member. One end of the release lever is positioned to disengage the locking pin against the spring force. At the other end of the lever is a large, flat actuator pad, located for convenient access by a wheelchair occupant.

7 Claims, 4 Drawing Figures

LATCH AND RELEASE MECHANISM FOR WHEELCHAIR FOOTREST

BACKGROUND OF THE INVENTION

The present invention relates to an improved wheelchair structure, and more particularly to a latching and release mechanism for a swingable footrest support on a wheelchair.

The provision of legrests and footrests for mounting on wheelchairs is well known. Typically, a foot or legrest is attached to a tubular standard, with the standard pivotally mounted to a forward tubular frame member of the wheelchair, thus to enable pivoting the footrest between a support position in which it is used by the wheelchair occupant, and a clearance position in which the footrest is supported laterally of the wheelchair in order to facilitate access to the wheelchair or exit from it, or to move the forward end of the wheelchair more closely to a table or bed.

Frequently, the wheelchair footrest standards are designed to be completely removable from the wheelchair when in the clearance position. Such structure is shown in U.S. Pat. No. 3,854,744 to Limpach granted Dec. 17, 1974, and in U.S. Pat. No. 3,482,873 to Pivacek granted Dec. 9, 1969. Such structure also is shown in U.S. Pat. No. 3,205,007 to Sommer granted Sept. 7, 1965.

U.S. Pat. No. 3,453,027 to Pivacek granted July 1, 1969 shows a footrest support including a vertical tube S pivotally attached to a front post P of a wheelchair, through plates 1 and 3 attached to the tube and mating plates 2 and 4 on the post. A similar arrangement is shown in U.S. Pat. No. 4,176,879 to Rodaway granted Dec. 4, 1979, wherein openings 21 and 22 in footrest tube portions 19 and 20 associate with pins 17 and 18 integral with vertical wheelchair tube 15. A lever 26 is provided to release a spring loaded plunger 24 to permit the footrest to swing away from the front of the wheelchair.

While the devices shown in these patents may perform adequately, particularly when operated by an attendant to assist the wheelchair occupant, they are unnecessarily burdensome and dangerous to the wheelchair occupant attempting to disengage the footrest independently of an attendant. The levers and other release means shown are comparatively small and inaccessible, requiring a level of manual dexterity which may exceed that of certain wheelchair occupants and be a source of embarrassment and discomfort.

It therefore is an object of the present invention to provide an improved system for releasably locking detachable swinging footrests or legrests on conventional wheelchairs.

Another object of the invention is to provide a reliable latching and releasing mechanism easily accessible to the wheelchair occupant.

Yet another object is to provide a latching and releasing mechanism for a wheelchair footrest operable remote from the point of latching, to enhance safety for a wheelchair occupant or attendant.

SUMMARY OF THE INVENTION

To achieve these and other objects, there is provided in combination with a wheelchair having a frame including at least one generally vertically disposed forward frame member and a swingable detachable footrest assembly releasably coupled to the frame member for swingable rotation between an operative forward position and an inoperative lateral position, a latching means for releasably locking the footrest assembly into the forward position. The latching means includes a lever means pivotally secured to the frame member and a locking pin mounted on the frame and adapted to releasably engage the footrest assembly. The locking pin has a shank portion and a tip portion and is movable toward and away from a footrest engaging position. A lock opening formed in the footrest assembly is adapted to receive the tip portion of the locking pin. The latching means further includes an elongated release lever with a pivot means disposed generally medially along its length for mounting it pivotally with respect to the frame member. The lever has opposite pin engaging and manual actuating ends. The pin engaging end is coupled to the shank portion of the locking pin for releasably disengaging the pin from the footrest assembly. The manual actuating end has a generally rectangular pad which is pushed to pivot the lever means, disengaging the locking pin to release the footrest assembly.

Preferably, the hand engaging pad is generally of a size between approximately one and two inches on one side.

Another aspect of the present invention is a latching mechanism for a wheelchair footrest assembly. The latching mechanism includes a wheelchair frame having at least one forwardly disposed generally upright frame member. The latching mechanism further includes a footrest assembly including a standard for supporting a footrest or legrest. A mounting means is provided for supporting the standard to pivot with respect to the frame member, between a support position in which the standard is in front of the frame member, and a clearance position in which the standard is displaced from in front of the frame member. A locking means is mounted to the frame member and positioned to releasably engage the footrest assembly to maintain it in the support position, and a biasing means urges the locking means into engagement with the footrest assembly. A release lever is pivotally mounted with respect to the frame member and is pivotable to disengage the locking means from the footrest assembly against the force of the biasing means.

The release lever includes a beam, and pivot means for mounting the beam, at a medial section thereof, pivotally with respect to the frame member. The release lever further includes an elongate, cantilevered tongue at one end of the beam extended at an angle from the beam, with the free end portion of the tongue positioned to contact the locking means and disengage it responsive to pivoting of the beam. The release lever further includes a cantilevered arm with one end portion attached to the beam at the other end of the beam with the other end portion of the arm being remote from the beam. A generally flat pad is located at the other end portion of the arm and selectively oriented for convenient pushing thereagainst by a wheelchair occupant in order to pivot the beam.

Preferably the tongue and beam are mounted in proximate surrounding relation to the frame member.

Further, the locking means can include an elongate locking pin having a head, tip, and shank, The shank is smaller in diameter than the head and tip. The tongue at its free end then includes a slot for receiving the shank, and with a diameter smaller than the head diameter. The biasing means includes a coil spring in compression surrounding the shank between the tip and tongue, with the head disposed against the opposite side of the tongue. The spring thus urges the tip into engagement with the footrest assembly.

The cantilever arm preferably includes a first arm section extended from the beam and generally parallel to the tongue, and a second arm section extended from the first arm section in a direction generally parallel to the extension of the frame member. Further, the first arm section preferably extends from the beam in the direction opposite to that which the tongue extends from the beam.

Using the latching mechanism of the present invention, wheelchair occupants can release the footrest assembly simply by pushing against the pad. There is no need for bending downward in an awkward search for some tiny actuator located well beneath the seat portion of a chair. The pad is remote from the pivoting beam, to locate it for the occupant's convenience, and ensure that a hand operating the latching mechanism is not pinched or otherwise injured by any of the moving parts. This increases safety not only for the occupant, but an attendant who might operate the mechanism. The size of the pad enables release of the latching mechanism without requiring undue manual dexterity, avoiding needless difficulty and embarrassment for wheelchair occupants of less than average dexterity, or occupants with artificial limbs. Thus, the release lever structure of the present invention can increase the independence and confidence of wheelchair occupants.

IN THE DRAWINGS

The above and other features and advantages are better appreciated from examining the following detailed description in view of the drawings, in which.

DESCRIPTION OF THE PREFERRED EMBODIMENT

Figure 1:
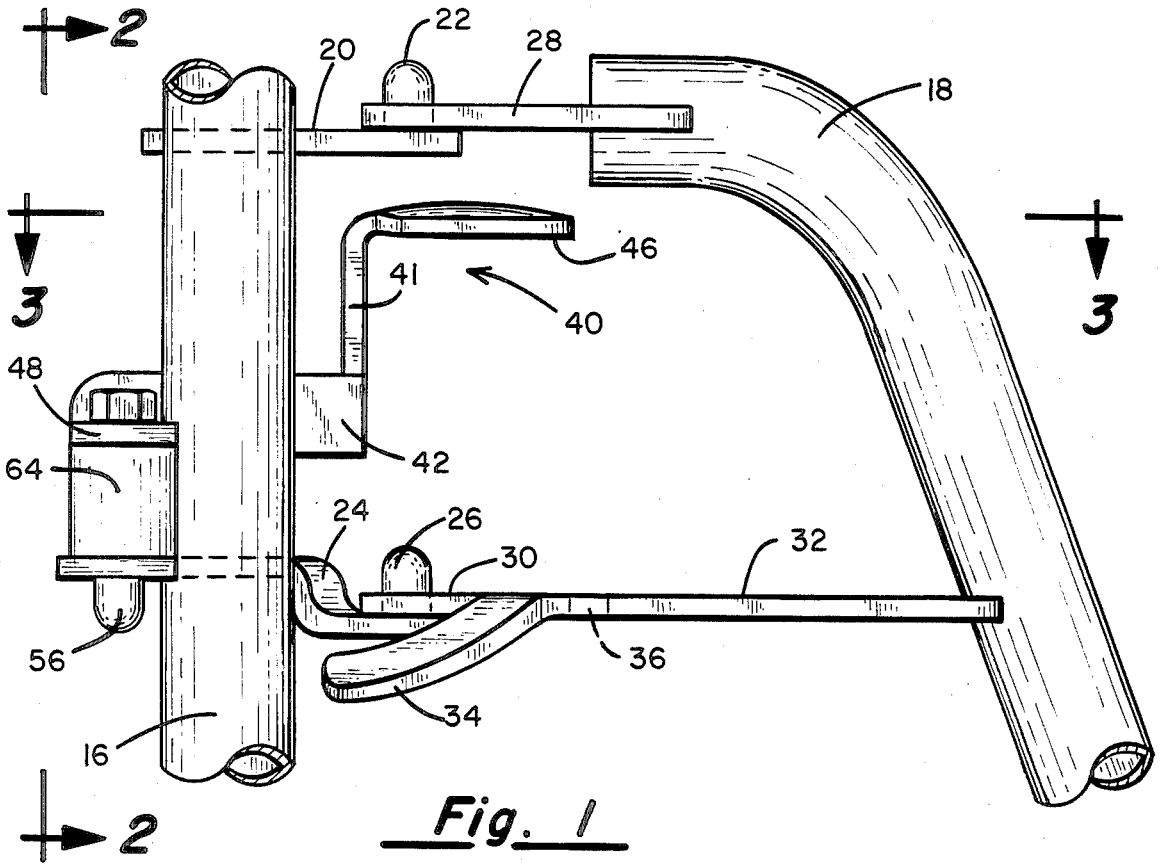
FIG. 1 is a front elevation showing a portion of a wheelchair frame member, to which is mounted a latching mechanism constructed in accordance with the present invention.

Turning now to the drawing, there is shown in FIG. 1 a segment of an upright tubular frame member 16 of a wheelchair. Frame member 16 comprises the left forward supporting post, located between the wheelchair's left front wheel and a horizontal frame member which supports the wheelchair seat. The left footrest and legrest of the wheelchair are supported by frame member 16. The footrest and legrest on the right side of the wheelchair are supported by a corresponding right forward post located between the right forward wheel and seat supporting horizontal frame member on the right side of the chair. Such an arrangement is shown, for example, in U.S. Pat. No. 4,176,879 mentioned above. Mounted to frame member 16 is a tubular standard 18 of which the upper segment is shown. Standard 18 is part of a footrest assembly. A legrest assembly can be similarly mounted.

Two brackets are attached to frame member 16 for supporting standard 18 pivotally. An upper bracket 20 supports an upwardly extended first hinge pin 22 spaced apart from the frame member, while a lower bracket 24 similarly supports a second hinge pin 26 in vertical alignment with first hinge pin 22. Lower bracket 24 also comprises part of a locking mechanism as is later explained.

Mounted to standard 18 and associated with upper and lower brackets 20 and 24, are an upper hinge plate 28 and a lower hinge plate 30. Hinge plates 28 and 30 have openings, each with a slightly large diameter than its associated one of hinge pins 22 and 26. Consequently, with plates 28 and 30 resting on brackets 20 and 24, the plates are rotatable on their associated brackets to enable standard 18 to pivot with respect to frame member 16 about a vertical axis determined by the hinge pins. Even when free of the locking mechanism as shown in FIG. 1, standard 18 remains mounted with respect to the frame member by gravity, but can be removed from the frame member if desired simply by vertical lifting of the standard.

Attached to standard 18 opposite lower hinge plate 30 is a locking plate 32, which includes a downwardly inclined end portion 34 and a lock opening 36 formed in the locking plate at a location between standard 18 and end portion 34.

Locking plate 32 cooperates with a locking mechanism mounted to frame member 16 to secure standard 18 against pivoting. The locking mechanism includes a release lever 40 having a beam 42 mounted to the rearward face of frame member 16 by a pivot pin 44 to pivot in the clockwise and counterclockwise directions as viewed in FIG. 1. Lever 40 further includes an arm 41 mounted to one end of the beam and extending to an arm end portion remote from the beam, which supports a lever actuator pad 46.

Figure 4:
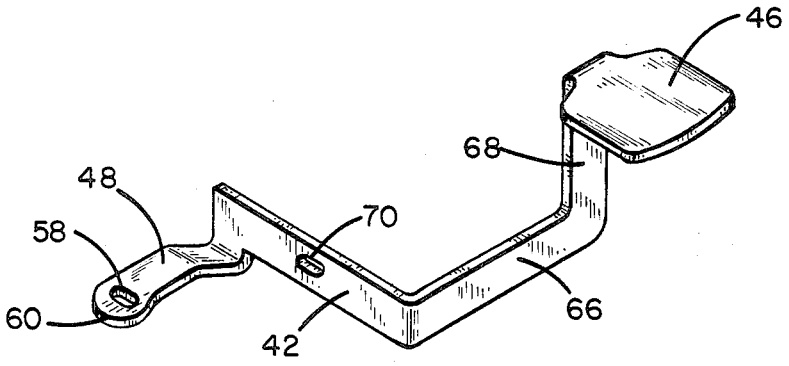
FIG. 4 is a perspective view of a release lever of the latching mechanism.

At the opposite end of beam 42 is a locking tongue 48 which extends away from the beam in the forward direction. Carried on tongue 48 is an elongated locking pin 50 including an intermediate shank 52, and at opposite ends of the shank a head 54 and an enlarged tip 56. Pin 50 extends through a slot 58 in the tongue (FIG. 4).

Figure 2:
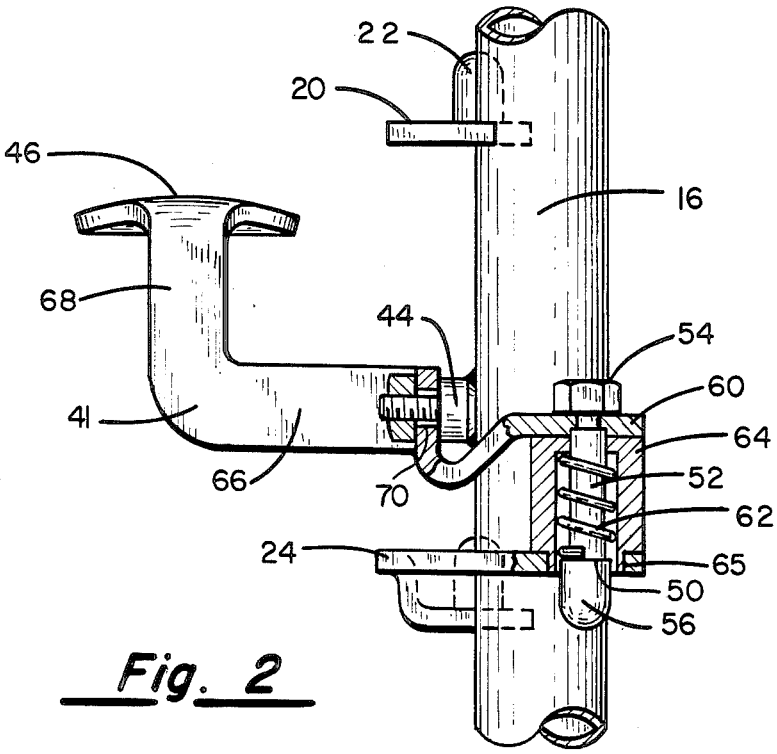
FIG. 2 is a side elevation of the frame member and latch of FIG. 1.

In FIG. 2, part of a locking sleeve 64 is removed to show that pin 50 is maintained with respect to a free end 60 of tongue 48 by a coil spring 62 under compression. The lower end of spring 62 bears against the top of enlarged tip 56, while the upper end of the spring bears against the top inside surface of locking sleeve 64 surrounding the spring and attached to bracket 24. Spring 62 consequently tends to urge locking pin 50 downward, thus to keep head 54 against free end 60 of the tongue and to keep tip 56 extended below bracket 24 through a bore 65 formed therein.

From FIG. 2 it is apparent that arm 41 includes a first arm section 66 which extends horizontally and rearwardly from beam 42, and a second arm section 68 extending upwardly from the rearward end of the first section, with the upper end of the second arm section supporting pad 46. Arm sections 66 and 68 position pad 46 where it is readily accessible to the wheelchair occupant. Preferably, pad 46 is oriented horizontally for easy pushing. Because arm 41 supports the pad at a location remote from pivot pin 44 and locking pin 50, there is virtually no possibility of a pinched finger or other injury to the wheelchair occupant or attendant manipulating the release lever.

Figure 3:
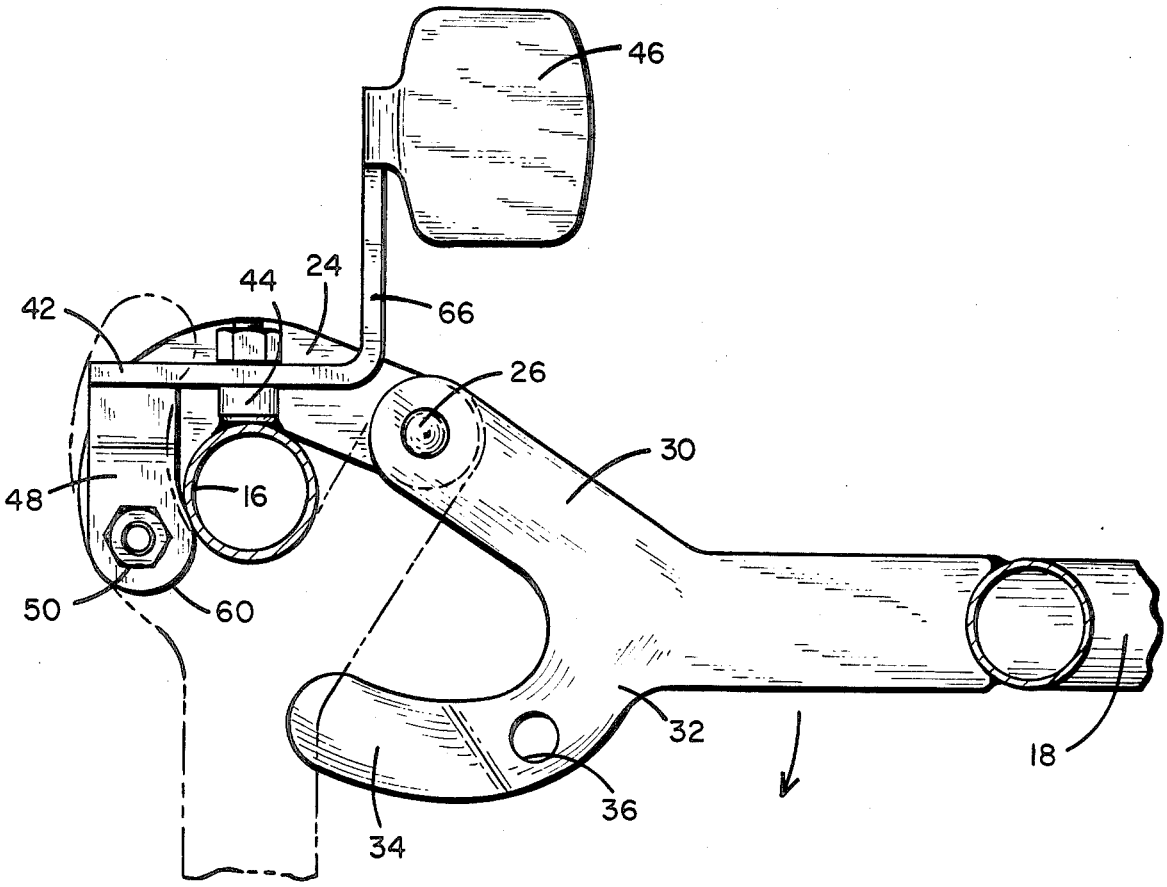
FIG. 3 is a sectional view of the frame member and latch taken along the line 3—3 of FIG. 1.

FIG. 3 illustrates two positions of support standard 18 with respect to frame member 16: a forward support position in which standard 18 is positioned directly in front of frame member 16 (shown in broken lines); and a lateral clearance position in which the standard, pivoted clockwise about hinge pins 22 and 26, is clear of the front of the wheelchair. This removes any footrest or legrest carried by the standard from in front of the wheelchair.

FIG. 4 shows release lever 40, which preferably is constructed of metal, with a nominal thickness of $\frac{1}{8}''$. Tongue 48, extended forwardly from the bottom of one end of beam 42, is enlarged at its free end 60 to accommodate slot 58. Slot 58 is elongated in the direction of beam extension, thus to accommodate the slight lateral movement by tongue 48 with respect to locking pin 50 as it lifts the locking pin against the force of coil spring 62. A pivot opening 70 is provided in beam 42 to accommodate pivot pin 44, preferably toward the center of the beam. Actuator pad 46 is preferably $1\frac{1}{2}''$ square, although the critical requirement is not the particular dimension or shape, but that the pad be easily located and manipulated.

In operation, lever 40 is pivoted between a locking position for maintaining standard 18 in its support position, and a release position that allows pivoting of the standard away from the support position. Coil spring 62 continually biases release lever 40 toward its locking position. Standard 18 can be moved from its clearance position into the support position with lever 40 in the locking position.

Continued pivoting of standard 18 toward its support position carries end portion 34 toward frame member 16 until it contacts tip 56. Upon further pivoting, inclined end portion 34 provides a ramp surface which moves tip 56 upwardly against the force of coil spring 62, elevating head 54 above tongue 48. Continued pivoting eventually brings lock opening 36 into alignment with tip 56, whereupon the tip is forced into opening 36 by the coil spring, thus to capture locking plate 32 and maintain standard 18 in the support position.

Release of standard 18 is accomplished by pushing downward upon pad 46 to pivot beam 42 clockwise as viewed in FIG. 1. This raises the tongue 48, which, by virtue of its engagement with head 54, lifts locking pin 50 upwardly against the force of spring 62 until tip 56 is removed from opening 36, thus to free standard 18 for pivoting to the clearance position.

While the locking mechanism and standard described are for just the left side of a wheelchair, it can be appreciated that a corresponding support standard and locking mechanism are provided on the right side of the wheelchair in a substantially similar fashion. The release lever structure in accordance with the present invention allows wheelchair occupants a measure of independence in enabling them to release footrest and legrest assemblies without the assistance of an attendant, and without undue downward bending and groping for minute and remotely located latch release mechanisms. The operative sections of the release lever, namely the beam and locking tongue, are arranged in close, wraparound relation to the frame member and occupy a minimum of space. The arm extends away from these operative sections to support the pad remotely therefrom. This protects the wheelchair occupant from any injury which could result from contact with the operative sections of the locking and release mechanism.

What is claimed is:

1. A latching mechanism for a wheelchair footrest assembly, including:

an elongate vertically disposed frame member of a wheelchair frame; an assembly including a standard for supporting a footrest or legrest and a locking member integral with said standard; a mounting means for supporting said standard to pivot about a vertical axis with respect to said frame member, between a support position wherein said standard is in front of said frame member, and a clearance position wherein the standard is removed from in front of the frame member;

a locking means mounted with respect to said frame member and positioned for a releasable engagement with said locking member to maintain said assembly in the support position;

a biasing means for urging the locking means vertically into engagement with said locking member; and a release lever pivotally mounted with respect to said frame member and positioned to disengage said locking means from said locking member, said release lever including:

a beam, and pivot means for mounting the beam, at a medial portion thereof, generally perpendicular to said frame member for pivoting about a substantially horizontal axis relative thereto;

an elongate, cantilevered tongue at one end of said beam and extending at an angle from said beam, with the free end of said tongue positioned to contact said locking means and disengage it responsive to the pivoting of said beam;

a cantilever arm having one end portion attached to the other end of said beam, with the other end portion of the arm being remote from said beam; and a generally flat actuator pad attached to the other end portion of the arm and selectively oriented for convenient pushing thereagainst by a wheelchair occupant, and movable generally vertically downward to pivot said beam to so disengage said locking means.

2. The latching mechanism in claim 1 wherein:

said tongue and beam are supported in proximate surrounding relation to said frame member.

3. The latching mechanism of claim 1 wherein:

said locking means includes an elongated locking pin including a head portion, a tip portion and a shank portion intermediate the head portion and tip portion and smaller in diameter than the head portion and the tip portion; and wherein said tongue at its free end portion includes a slot for receiving said shank portion therein, and smaller in diameter than said head portion;

said biasing means includes a coil spring surrounding said shank portion and under compression between said tip portion and tongue, with said head portion disposed against the opposite side of the tongue.

4. The latching mechanism of claim 3 wherein:

said coil spring is further compressible to allow said head portion to move vertically away from said tongue.

5. The latching mechanism of claim 1 wherein:

said arm includes a first arm section extending from said beam in a direction generally parallel to the extension of said tongue, and a second arm section extended from said first arm section in the vertical direction to locate said pad vertically remote from said beam.

6. The latching mechanism of claim 5 wherein:

said first arm section extends from said beam in the direction opposite to that of tongue extension from the beam.

7. The latching mechanism of claim 1 wherein:

said locking member includes a generally horizontal locking plate, said locking plate having an end portion inclined from the horizontal and positioned to engage said locking means as said assembly is pivoted toward said support position and, upon further pivoting of said assembly, to provide a ramp surface for moving said locking means vertically against the force of said biasing means; and a lock opening in said locking plate for receiving said locking means to effect said releasable engagement.

* * * * *